US005791242A

United States Patent [19]

Kayser et al.

[11] Patent Number: 5,791,242

[45] Date of Patent: Aug. 11, 1998

[54] CALENDER FOR TREATING BOTH SIDES OF A PAPER WEB

[75] Inventors: Franz Kayser, Geldern; Rolf van Haag, Kerken; Ulrich Rothfuss, Grfrath; Reinhard Wenzel, Krefeld, all of Germany

[73] Assignee: Voith Sulzer Finishing GmbH, Krefeld, Germany

[21] Appl. No.: 612,170

[22] Filed: Mar. 7, 1996

[30] Foreign Application Priority Data

Mar. 9, 1995 [DE] Germany ..... 295 04 034 U

[51] Int. Cl.[6] ..... D21G 1/00

[52] U.S. Cl. ..... 100/331; 100/162 R; 100/162 B; 100/172; 100/173; 100/161

[58] Field of Search ..... 100/93 RP, 161, 100/162 R, 162 B, 163 R, 163 A, 164–166, 172, 173, 331, 103

[56] References Cited

U.S. PATENT DOCUMENTS

| | | | |
|---|---|---|---|
| 1,793,114 | 2/1931 | Minton | 100/163 A |
| 3,124,504 | 3/1964 | Mahoney et al. | 100/93 RP |
| 3,230,867 | 1/1966 | Nelson | 100/93 RP |
| 4,749,445 | 6/1988 | Vreeland | 100/93 RP |
| 5,237,915 | 8/1993 | Rounsley | 100/161 |
| 5,438,920 | 8/1995 | Koivukunnas et al. | 100/93 RP |

FOREIGN PATENT DOCUMENTS

| | | | |
|---|---|---|---|
| 0 027 270 | 4/1981 | European Pat. Off. . | |
| 295 04 034 U | 6/1995 | Germany . | |
| 1-183595 | 7/1989 | Japan | 100/162 R |

OTHER PUBLICATIONS

"Synthetic Composite Covers in Supercalenders: Update", by Thomas J. Lauterbach, dated Jun. 1993, pp. 115–119.

"Supercalendering and Soft Nip Calendering Compared", by John D. Peel, dated Oct. 1991, pp. 179–186.

"Die neuen Superkalanderkonzepte", Voith Sulzer Papiertechnik, 1994, No. May 1994 d.

*Primary Examiner*—Stephen F. Gerrity

*Attorney, Agent, or Firm*—Darby & Darby

[57] ABSTRACT

A calender for treating both sides of a paper web includes hard rollers and soft rollers. Working nips are formed between the juncture of each hard roller and soft roller. The roller stack can be loaded from one end, and preferably includes six to eight rollers. A changeover nip is formed by the juncture of two soft rollers or at the transition between two stacks. When using two stacks, each stack preferably has three to five rollers. At least one working nip has a dwell time of at least 0.1 ms. A heatable roller adjacent to the working nip is heated to a surface temperature of at least 100° C. The roller stack is loaded such that an average compressive stress in the working nip is greater than or equal to 42 N/mm$^2$.

14 Claims, 1 Drawing Sheet

CALENDER FOR TREATING BOTH SIDES OF A PAPER WEB

BACKGROUND OF THE INVENTION

1. Field of the Invention

The present invention relates to a calender for treating both sides of a paper web. More specifically, the present invention relates to a calender that is suitable for manufacturing paper that can be used in photogravure printing. The calender includes a roller stack that can be loaded from one end. The calender includes hard rollers and soft rollers. Working nips are formed between the juncture of a hard roller and a soft roller. The hard roller surface, disposed adjacent to the working nip, can be heated.

2. Discussion of the Related Art

Calenders for treating both sides of a paper web are known, for example, from the 1994 brochure "Die neuen Superkalanderkonzepte" [The New Supercalender Concepts], which is published by Sulzer Papertec company (identification number 05/94 d). These supercalenders are used for the final treatment of a paper web so that the web will obtain the desired degree of smoothness, gloss, thickness, bulk, and the like. These supercalenders are installed separately from an upstream paper machine. The soft or elastic rollers have an outer covering that is primarily made of fibrous material. The heatable rollers are heated to a surface temperature of up to about 80° C. The average compressive stress in the working nips during normal operation is between 15 and 30 N/mm$^2$. Additionally, in the lowest working nip, a compressive stress of 40 N/mm$^2$ has been applied. The rollers are arranged in a roller stack. The roller stack includes nine or ten rollers, which is sufficient for paper that is to be simply finished, such as writing paper. Twelve to sixteen rollers are required for higher-quality papers, such as paper that is suitable for photogravure printing, technical papers, or compression papers. A calender for such high quality papers is expensive and requires a large amount of space.

Compact calenders are also known. Compact calenders have a heatable roller, which forms a nip with a deflection-controllable soft roller. Two compact calenders can be connected in series to treat both sides of a paper web. However, compact calenders can only be used to manufacture papers that require simple finishing. These calenders can not be used to treat high quality papers, such as silicon based papers or papers for photogravure printing. Compact calenders require that a large amount of deformation energy, in the form of heat, be added to operate the calender. Therefore, the heatable rollers have a surface temperature ranging from 160° C. to 200° C. A great deal of heat energy radiates from the compact calender, which must be exhausted using air conditioners. Because the roller diameter in a compact calender is larger (for sturdiness purposes) than the roller diameter in a super-calender, higher loads per unit of length must be applied to produce the required compressive stresses for the desired finishing result. Furthermore, replacement rollers for the soft rollers are expensive because they must also be deflection-controllable.

Accordingly, it is an object of the present invention to provide a calender that affords excellent finishing results, yet is smaller and less expensive to manufacture and operate.

SUMMARY OF THE INVENTION

The object is achieved in accordance with a preferred embodiment of the present invention by providing a calender for treating both sides of a paper web. The calender includes a plurality of hard rollers and a plurality of soft rollers that are aligned in a roller stack. The roller stack has a first end and a second end. The stack includes a working nip formed by the juncture of a hard roller and a soft roller. At least one of the plurality of hard and soft rollers includes a device for heating a surface of the roller to a temperature of at least 100° C. The roller stack is loaded from the first end such that the average compressive stress in at least one of the working nips is greater than or equal to 42 N/mm$^2$. The at least one working nip has a predetermined width so that a dwell time of the paper web passing through the working nip is at least 0.1 ms. The roller stack includes, in one embodiment, from six to eight rollers. A changeover nip is formed by the juncture of two soft rollers. In a second embodiment the calender includes two roller stacks. Each of the first roller stack and the second roller stack has from three to five rollers.

The effect of the roller weight on the load per unit of length is decreased by reducing the stack height. Therefore, in accordance with the teachings of the present invention, it is possible to have the same load per unit of length in the lowest working nip as compared to the prior art calenders, while the load per unit of length in the uppermost working nip is greater than the load applied in supercalenders of the prior art. Surprisingly, it is therefore sufficient to only moderately increase the deformation energy that is supplied, while still being able to satisfactorily process high-quality papers. For example, heat can be added at temperatures that are only slightly above the previous customary temperatures and, thus, only slightly increasing the heat radiation. In addition, many different heat transfer devices may be used because the lower heat requirements of the present invention avoid the difficulties encountered when using the high temperatures, which are required for a compact calender. The present invention also only requires a relatively slight increase in the compressive stress applied in the working nip, which can be mechanically tolerated without requiring any structural modification of the calender assembly. At most, the soft roller covering material may need to be modified to accommodate the slight increase in the heat and compressive stress.

Since both factors (increased heat and increased load) can be applied simultaneously in at least one working nip, preferably the lowest working nip, unusually good results in the properties of the paper web after final treatment can be achieved. This is true even when treating high quality papers with a rapidly running calender. Because the roller stack is not as tall as supercalenders of the prior art, lower structures can be built, which significantly reduce the installation cost.

The calender according to the present invention is preferably comprised of a single roller stack of six to eight rollers or a double roller stack of three to five rollers. Both the single roller stack and the double roller stack provide practically the same finishing results as a customary twelve-roller calender that was previously considered necessary to produce high quality papers that are suitable for photogravure printing. Using two roller stacks has the additional advantage that the load per unit of length is less dependent on the weight of the rollers. Thus, a much higher load per unit of length can be achieved in each of the uppermost working nips than was previously the case.

In a preferred embodiment, the dwell time of the paper web passing through a working nip is at most 0.9 ms. A surface of the roller adjacent to the working nip is preferably designed to reach a maximum surface temperature of 150° C. The roller stack is loaded so that an average compressive stress is less than or equal to 60 N/mm$^2$. Therefore, only a moderate increase in the surface temperature and the compressive stress is actually necessary as compared to conventional supercalenders. These slight increases can be tolerated because the increased valves are evenly distributed among the working nips.

The dwell time is preferably between 0.2 ms and 0.5 ms, the surface temperature is preferably between 110° C. to 125° C., and the average compressive stress is preferably between 45 N/mm$^2$ and 55 N/mm$^2$. It is particularly advantageous for these requirements to apply to all or at least a majority of the working nips.

The upper and/or lower rollers are preferably deflection controllable rollers. Thus, the compressive stress can be distributed evenly over the entire width of the rollers.

The upper and lower hard rollers are also preferably heated. Heat energy is preferably applied to the hard rollers because these rollers can be more easily heated than soft rollers. This is especially true when the upper and lower rollers are deflection controllable, because the pressure fluid, which is used to adjust the deflection, can be heated to control the heating of these rollers.

It is particularly beneficial for the soft rollers to have an outer plastic covering. Plastic covered rollers operate significantly better than rollers which are covered with a fibrous material at increased average compressive stresses. The plastic covered rollers allow operation at a compressive stress of more than 42 N/mm$^2$. In particular, the plastic covering should be designed to permit a compressive stress in the working nip of up to about 60 N/mm$^2$.

The plastic covering is preferably made of a fiber-reinforced epoxy resin, which typically has a useful life of at least 12 weeks.

In an additional embodiment of the present invention, the roller stack or stacks are arranged in-line (i.e., in series) with a paper machine or a coating machine. The paper web is thus at a relatively high temperature at the intake nip of the calender (e.g., 60° C.) and therefore the web only requires a slight addition of heat to provide sufficient deformation. Plastic coverings, which are already desirable because of the higher compressive stresses that they can withstand, are particularly suitable for in-line operations, because, in contrast with coverings made of fibrous material, they are significantly less susceptible to marking. Therefore, plastic coverings rarely need to be removed and reworked, for example, by grinding. Calenders comprised of two roller stacks have the additional advantage of being more suitable for in-line operation, because the running paper web in each stack is fed through a lower number of working nips.

Each of the rollers in a roller stack is preferably driven independently of the other rollers. The paper web can therefore be independently pulled in while the calender is running because all of the rollers can be brought to the same speed before the nips are closed.

The roller stack is preferably covered by a protective hood which reduces the amount of heat radiating from the calender. The protective hood ensures that the manufacturing facility is not overheated, which would require excessive air conditioning. Conversely, the temperature inside the hood is preferably maintained at a predetermined higher level than in conventional calenders, so that the addition of heat through the heating device can be minimized.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENTS

Figure 1:
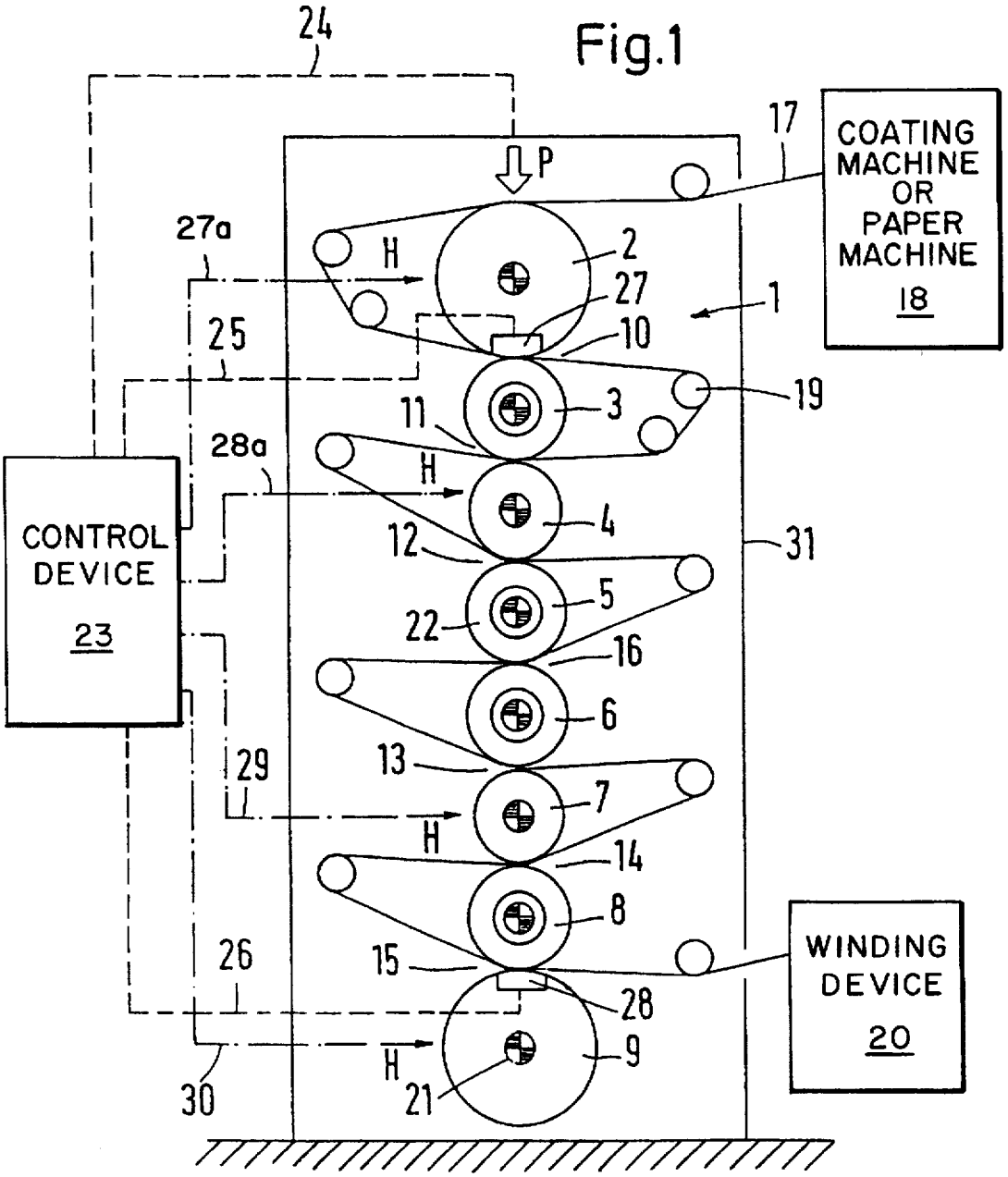
FIG. 1 is a schematic side view of a calender in accordance with the present invention.

Referring now to FIG. 1, a calender 1 having one roller stack is illustrated. The roller stack is preferably comprised of eight rollers. The eight rollers include a heatable deflection-controllable hard upper roller 2, a soft roller 3, a heatable hard roller 4, a soft roller 5, a soft roller 6, a heatable hard roller 7, a soft roller 8, and a heatable deflection-controllable hard lower roller 9. This arrangement of the eight rollers creates six working nips 10, 11, 12, 13, 14 and 15 and a changeover nip 16. Each of the working nips 10–15 are formed by the juncture of one hard roller and one soft roller. The changeover nip 16 is formed by the juncture of two soft rollers 5 and 6. A web of paper 17 is fed out of a paper machine or coating machine 18. The web 17 is guided by a plurality of guide rollers 19 so that it passes through the working nips 10–12, the changeover nip 16, and the working nips 13–15. Thereafter, web 17 is wound onto a winding device 20. As the web 17 passes through the top three working nips 10–12, only one side of the paper web contacts the hard rollers 2, 4. However, as the web 17 passes through the three lowest working nips 13–15, only the opposite side of the paper web contacts the hard rollers 7, 9. Thus, the desired surface structure properties, such as smoothness and gloss, is produced on both sides of the paper web.

The illustrated assembly is known in the art as an in-line operation because the output of the paper machine or coating machine 18 is directly connected to the input of the calender 1. In an in-line operation, each of the rollers 2–9 preferably is driven independently by a separate drive 21 so that the paper web 17 can be selectively pulled in during operation. Each of the soft rollers 3, 5, 6, and 8 has an outer covering 22 made of plastic. In a preferred embodiment, the plastic is a fiber-reinforced epoxy resin. This material is less susceptible to marking than a covering made of fibrous material. Thus, the soft roller has a significantly longer useful life, which is important for in-line operation. This material can also be subjected to higher compressive stress and is resistant to higher temperatures than a covering made of fibrous material. This plastic covering is commercially available, for example, from the Scapa Kern Company of Wimpassing, Austria and is sold under the brand name "TopTec 4"™.

A control device 23 is operatively connected to the calender. For example, the force P with which the upper roller 2 is pressed downward is controlled over a line 24. In a preferred embodiment, the lower roller 9 is held stationary. However, the load can also move in the opposite direction, so that the force P acts on lower roller 9 and the upper roller 2 is fixed. The load determines the compressive stress that is applied in the individual working nips 10–15. The compressive stress increases from the top to the bottom because the weight of the individual rollers is added to the loading force P. However, the differential increase in force in each stack according to the present invention is less than the differential increase in force in each stack of the prior art supercalenders which have from nine to sixteen rollers.

A deflection compensating device 27, 28 is disposed in each hard roller 2, 9, respectively, to adjust the deflection of the upper roller 2 and the lower roller 9, respectively. Control device 23 controls the amount of pressure that is applied along control lines 25, 26, via a pressure device, to the deflection compensating devices 27, 28, respectively, so that the deflection in each roller 2, 9 is adjusted. Deflection devices 27, 28 ensure that there is an even compressive stress applied over the axial length of the roller. Any conventional deflection compensating device can be used.

However, it is preferred to use those devices in which support elements are arranged next to each other in a row, which elements can be pressurized individually or in zones at different pressures.

Hard rollers 2, 4, 7, and 9 are heatable, as shown by arrows H. The amount of heat energy that is added is controlled by the control device 23 along control lines 27*a*, 28*a*, 29, 30. The heating may be effected, for example, by electric heating, radiant heating or a heat exchange medium. A protective hood 31 provides heat insulation and ensures that heat that is radiated as a result of the heating is exhausted into the environment to only a slight extent.

The average compressive stress σ applied in at least the lowest working nip 15, and preferably in all of the working nips 10–15, is preferably maintained between 45 N/mm$^2$ and 60 N/mm$^2$ due to force P. The surface temperature of the heatable rollers 2, 4, 7, and 9 is preferably maintained between 100° C. and 150° C. due to the heating H. The diameter of the rollers and the elasticity of the covering 22 are selected so that a nip width of about 2–15 mm, and preferably about 8 mm, is maintained. The dwell times t of the web 17, in each working nip is about 0.1 to 0.9 ms. The dwell time is a function of the web speed. In a preferred embodiment, the temperature T is only slightly above the lower limit, for example 110° C., and the compressive stress is only slightly above the lower limit, for example 50 N/mm$^2$.

The present inventors have determined that the printability of natural and lightly coated papers is not necessarily related to the gloss or smoothness achieved in the paper web, but is instead related to compression or its reciprocal value bulk (in cm$^3$/g). The measurement of printability in photogravure printing is determined by the number of "missing dots" in the quartertone and halftone area. The best results in that regard are thus obtained when it is ensured that all of the limits specified above are maintained in all working nips.

Figure 2:
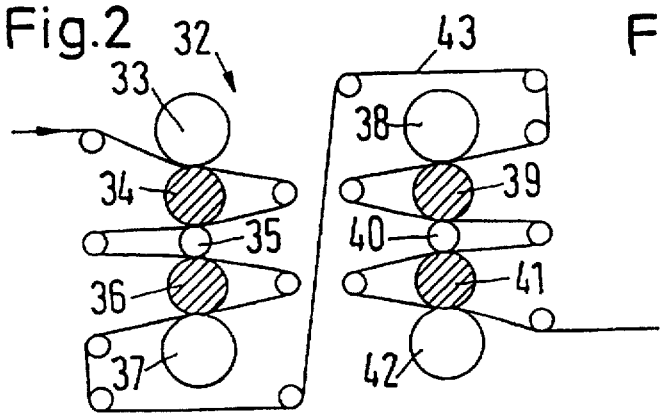
FIG. 2 is a schematic side view of a second embodiment of the present invention.

FIG. 2 shows a two roller stack calender 32, where each stack has five rollers. Thus, the calender is known as a 2×5 roller calender 32. The first stack includes a hard upper roller 33, a soft roller 34, a hard roller 35, a soft roller 36, and a hard lower roller 37. The second stack includes a hard upper roller 38, a soft roller 39, a hard roller 40, a soft roller 41, and a hard lower roller 42. Each stack therefore has three working nips through which the paper web 43 runs in such a way that in the first stack one surface of the web comes into contact with the three hard rollers and in the second stack the other web surface comes into contact with the three hard rollers. The heating of the rollers, the deflection control of the upper and lower rollers, and the loading of the two roller stacks can be achieved in a similar manner to that of the calender illustrated in FIG. 1.

Figure 3:
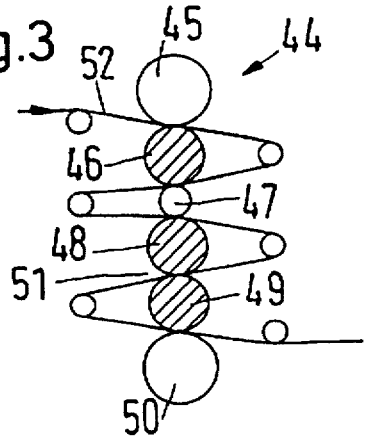
FIG. 3 is a schematic side view of a third embodiment of the present invention.

FIG. 3 shows a one roller stack calender 44, which stack has six rollers. The single stack includes a hard upper roller 45, a soft roller 46, a hard roller 47, soft rollers 48 and 49, and a hard lower roller 50. A changeover nip 51 is located between the soft rollers 48 and 49. One surface of the paper web 52 contacts hard rollers 45, 47 and the other web surface contacts hard roller 50. Thus, one surface of the paper web 52 is finished above the changeover nip 51, while the other surface is finished below nip 51.

The results of paper treatment can often be improved when the rollers, particularly the middle rollers, are held by levers (not shown) so that the overhanging weights are preferably compensated for by support devices, as is known from European reference EP 0 285 942 B1.

Having described the presently preferred exemplary embodiment of a calender for treating both sides of a paper web in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

We claim:

1. A calender for treating both sides of a paper web, comprising:

a plurality of hard rollers and a plurality of soft rollers being aligned in a roller stack, said roller stack having a first end and a second end, said stack including a plurality of working nips each being formed by the juncture of one of said hard rollers and one of said soft rollers, at least one of said plurality of hard and soft rollers including means for heating a surface of said roller to a temperature of at least 100° C., said roller stack being loaded from said first end such that the average compressive stress in at least one of said working nips is no less than 42 N/mm$^2$, said at least one working nip having a predetermined width so that a dwell time of said paper web passing through said working nip is at least 0.1 ms.

2. The calender according to claim 1, wherein said dwell time is at most 0.9 ms, said heating means heats said roller surface to a maximum temperature of 150° C., said roller stack being loaded such that said average compressive stress is at most 60 N/mm$^2$.

3. The calender according to claim 2, wherein said dwell time ranges from 0.2 ms to 0.5 ms, said surface temperature ranges from 110° C. to 125° C., and said average compressive stress ranges from 45 N/mm$^2$ to 55 N/mm$^2$.

4. The calender according to claim 3, wherein said dwell time ranges, said surface temperature ranges and said average compressive stress ranges apply to a majority of said working nips.

5. The calender according to claim 1, wherein said roller disposed at said first end and said roller disposed at said second end are deflection-controllable.

6. The calender according to claim 5, wherein said deflection controllable rollers are heatable.

7. The calender according to claim 6, wherein said soft rollers include a plastic covering.

8. The calender according to claim 7, wherein said plastic covering supports a compressive stress up to 60 N/mm$^2$.

9. The calender according to claim 7, wherein said plastic covering is substantially comprised of a fiber-reinforced epoxy resin.

10. The calender according to claim 1, wherein said roller stack is arranged in-line with one of a paper machine and a coating machine.

11. The calender according to claim 1, wherein each of said plurality of hard and soft rollers are driven independently.

12. The calender according to claim 1, wherein said roller stack is covered by a protective hood that reduces heat radiation emitting from said roller stack.

13. The calender according to claim 1, wherein the roller stack includes from six to eight rollers, a changeover nip being formed by the juncture of two soft rollers.

14. The calender according to claim 1, further comprising a second roller stack, each of said first roller stack and said second roller stack having from three to five rollers.

* * * * *